US007105764B2

(12) United States Patent
Rakus et al.

(10) Patent No.: US 7,105,764 B2
(45) Date of Patent: Sep. 12, 2006

(54) MONOLITHIC STATIONARY CONDUCTOR AND CURRENT LIMITING POWER SWITCH INCORPORATING SAME

(75) Inventors: Paul R. Rakus, Chippewa Township, PA (US); Thomas C. Pendrick, Clinton, PA (US); John J. Shea, Pittsburgh, PA (US); Michael B. Schulman, Pittsburgh, PA (US); Yun-Ko N. Chien, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/035,228

(22) Filed: Jan. 13, 2005

(65) Prior Publication Data

US 2006/0151437 A1 Jul. 13, 2006

(51) Int. Cl.
*H01H 33/02* (2006.01)

(52) U.S. Cl. ..... 218/34; 218/30; 218/146; 335/201

(58) Field of Classification Search ..... 218/7, 218/14–21, 22, 30, 34–41, 46, 76, 78, 148, 218/149, 153, 154, 155, 157; 335/201–204
See application file for complete search history.

(56) References Cited

U.S. PATENT DOCUMENTS 4,654,491 A * 3/1987 Maier et al. ..... 218/33
4,849,590 A * 7/1989 Becker et al. ..... 218/33
4,973,805 A * 11/1990 Paton et al. ..... 218/40
4,975,553 A * 12/1990 Oster ..... 218/34
5,247,142 A 9/1993 Yonkovitz et al.
5,341,191 A 8/1994 Crookston et al.
5,969,314 A 10/1999 Rakus et al.
6,005,206 A 12/1999 Rakus et al.
6,376,788 B1 * 4/2002 Jones et al. ..... 218/32
6,392,512 B1 * 5/2002 Ferree et al. ..... 335/16
6,417,474 B1 7/2002 Rakus et al.

* cited by examiner

*Primary Examiner*—Elvin Enad
*Assistant Examiner*—M. Fishman
(74) *Attorney, Agent, or Firm*—Martin J. Moran

(57) ABSTRACT

A current limiting power switch has a monolithic stationary conductor with a conductor section that mounts fixed contacts that engage moving contacts on moving contact fingers to form a reverse current loop with the contacts closed. A terminal section projects transversely from one end of the conductor section and an arc runner section extends from the other end. The tapered arc runner has a generally laterally centered tapered area that gathers the arcs and urges them along a raised rib on the arc runner to an arc chute. A reinforcing rib running from the back of the conductor and arc runner sections to the terminal section resists distortion of the monolithic stationary conductor by the high temperatures and closing and electromagnetic forces during interruption.

5 Claims, 6 Drawing Sheets

MONOLITHIC STATIONARY CONDUCTOR AND CURRENT LIMITING POWER SWITCH INCORPORATING SAME

BACKGROUND OF THE INVENTION

1. Field of the Invention

This invention relates to electric power switches and in particular to such switches having a monolithic stationary conductor configured to enhance current limiting and resist distortion during closing and high current interruptions.

2. Background Information

Power circuit breakers typically are used as a main breaker in a power distribution system having additional downstream branch circuit breakers. They are also used as transfer switches for switching between alternative power sources, and as network protectors in larger distribution systems. In such systems, the power circuit breaker must have sufficient withstand capability to allow a downstream breaker to respond to a fault in order to minimize the extent of the outage. However, in the instance of a very large fault, such as a fault just downstream of the power breaker, it is desirable to have the power breaker respond promptly to limit the fault current. It is known to provide power circuit breakers with a blow open contact structure for this current limiting purpose. This opening is driven by the electromagnetic repulsion force between the contacts at fault current levels that is enhanced by the current path geometry. Current travels in the stationary line conductor to the contacts and through the moving fingers toward the load conductor. The current paths in the line conductors and the contact fingers are roughly parallel, close beside each other, and electrically out of phase, because at any instant current is traveling in one direction in the one conductor and in the opposite direction in the other conductor. This is commonly called a "reverse loop". The gap and other parameters of the contract structure, and of the remainder of the circuit breaker, are chosen so that the contacts remain closed at the desired "withstand", or "threshold", current level but open very rapidly at high short circuit interrupting current levels. The line conductor must have the mechanical strength to tolerate the high forces from the moving contacts and the high fault currents, and have high current carrying and heat conduction capacity for high continuous current ratings. In addition, an arc runner is needed to provide a smooth transition for an electrical arc to travel off of the contacts and toward the arc chute during interruption. The arc runner should center the arc within the arc chamber over the full range of currents up to a maximum interrupting rating without allowing it to stall on corners or at any abrupt transitions. An arc which is offset severely to one side of the arc chamber can track along the arc chamber wall and fail to enter the art chute plates, resulting in poor interruption performance. Finally, the stationary contact assembly must be mounted rigidly in the circuit breaker housing with accurate positioning of the conductor, contacts, arc runner and other key features with respect to each other, and with respect to the breaker frame and moving contacts and arc chute.

The stationary contact assembly, which includes the arc runner, must be manufactured in a way that has the flexibility to produce the desired geometry cost effectively. The stationary contact assembly for the high-interrupting (current limiting) version of the power circuit breaker should be interchangeable with a standard power circuit breaker contact assembly in the same housing, so that a high interrupting version can be offered cost effectively in the same product family.

Thus, there is room for improvement in current limiting power circuit breakers and particularly in the stationary contact assembly.

SUMMARY OF THE INVENTION

In accordance with the aspects of the invention, the line-side terminal, conductor and arc runner are combined in a monolithic stationary conductor that is cast as one piece per pole. Thus, there are no part-to-part joints that would produce heat and restrict heat flow. It also allows freedom over geometry for optimal electro-magnetic performance.

More particularly, aspects of the invention are directed to a monolithic stationary conductor for an electric power switch that comprises a conductor section having a main axis extending between front and rear faces of the conductor section, and a terminal section extending away from the rear face at a first end of the conductor section transversely to the main axis. An arc runner section extends from a second end of the conductor section and also has a front face and a rear face. In order to maximize the reverse loop, the conductor section has an elongated portion that extends from the second end along the main axis and a transition portion forming the first end of the conductor section and extending transversely to the main axis to join the terminal section. The terminal section has a first thickness in the direction of the main axis while the transition portion has a second thickness which is less than the first thickness. In addition, the transition portion can have a width which is greater than the width of the terminal section so that even though it is not as thick as the terminal section in order to lengthen the reverse loop, it retains the current carrying capacity by being wider.

In accordance with other aspects of the invention, the conductor section and arc runner section of the monolithic stationary conductor can have an integral reinforcing rib projecting transversely from their rear faces and extending to the terminal section to minimize distortion from the sizeable mechanical and magnetic forces imposed on the stationary conductor.

In accordance with additional aspects of the invention, the front face of the arc runner section tapers from the conductor section toward a free end. In addition, the front face of the arc runner section can have a generally laterally centered raised area that narrows in width from adjacent the conductor section toward the arc runner free end. This raised area can be a tapered raised portion tapering from adjacent the conductor section and a longitudinal raised rib extending from the tapered raised area toward arc runner the free end. Furthermore, the front face of the arc runner section, at least adjacent the conductor section, can form an obtuse angle with the front face of the conductor section.

The invention also embraces an electric power switch that incorporates the monolithic stationary conductor. More particularly, it is directed toward an electric power switch that comprises a housing, a moving contact assembly that comprises at least one moving contact finger having a moving contact affixed to a free end. The at least one contact finger is movable between a closed position and an open position. This switch also has a stationary contact assembly that comprises the monolithic stationary conductor. This monolithic stationary conductor comprises a conductor section having an elongated portion with a main axis extending between a front face and a rear face, a transition portion forming a first end of the conductor section and extending transversely to the main axis. The monolithic stationary conductor further includes a terminal section extending from the first end of the conductor section formed by the transition portion transversely to the main axis and an arc runner section extending from the second end of the conductor section formed by the elongated portion and also having a front face and rear face. At least one fixed contact is mounted on the front face of the elongated portion adjacent the second end of the conductor section. Finally, the electric power switch comprises an arc chute toward which the arc runner section of the monolithic stationary conductor extends. The at least one contact finger when in the closed position extends in spaced relation along the front face of the elongated portion of the conductor section of the monolithic stationary conductor assembly with the moving contact of the at least one moving contact finger engaging the at least one fixed contact to form a reverse current loop. The monolithic stationary conductor can have any or all of the features described above. In addition, the reinforcing rib can have a thickened medial post extending transversely to the main axis that seats against the housing to absorb the high closing and interruption forces. The transition section of the monolithic stationary conductor can have a width greater than that of the terminal section forming shoulders that seat against the housing to position the conductor and also aid in absorbing the closing and interruption forces.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
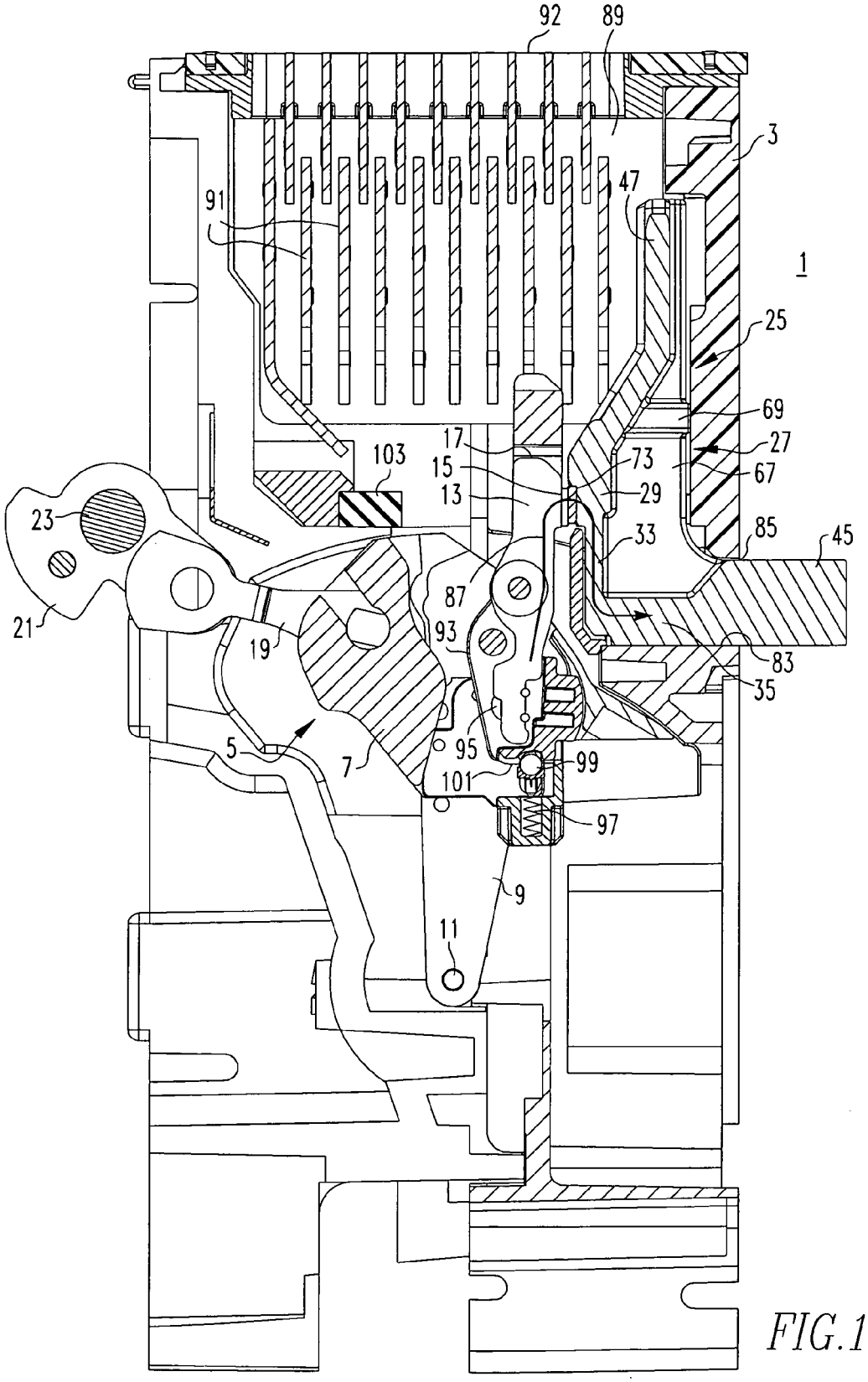
FIG. 1 is a vertical section through the pertinent portion of one pole of a current limiting power circuit breaker in accordance with the invention shown in the closed position.
Figure 2:
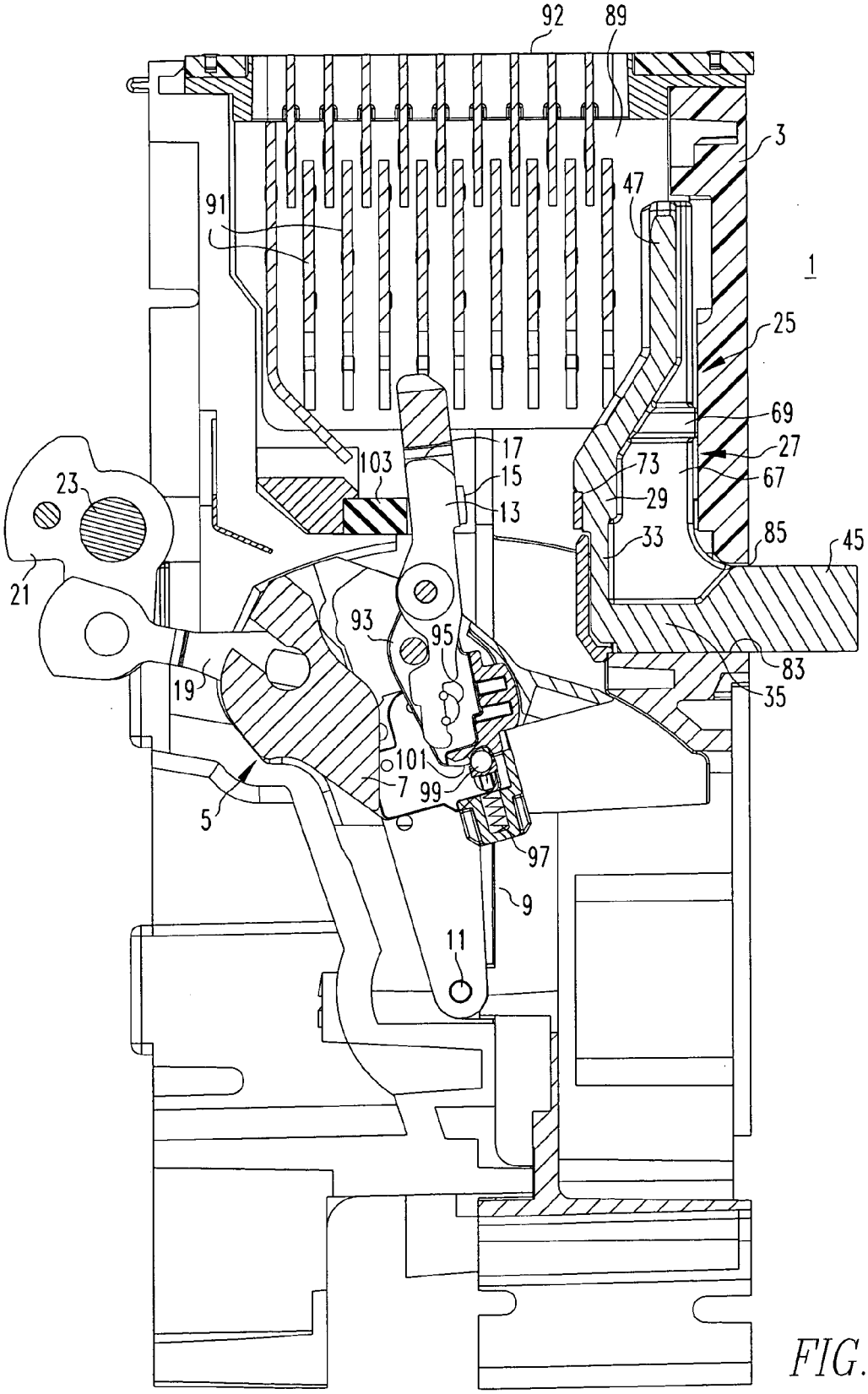
FIG. 2 is similar to FIG. 1 showing the current limiting power circuit breaker in the open position.
Figure 3:
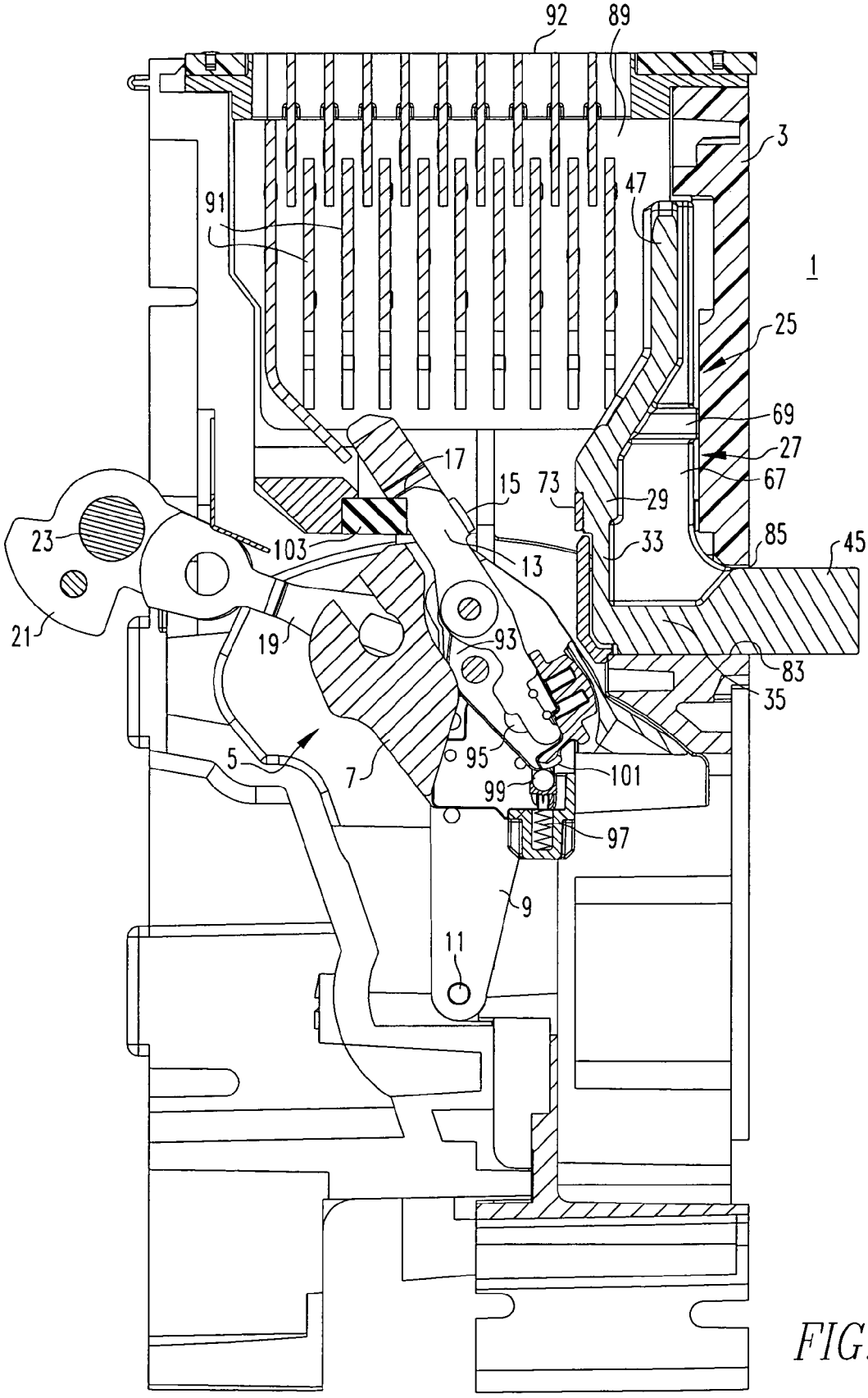
FIG. 3 is similar to FIGS. 1 and 2 but showing in the current limiting power circuit breaker in the blown open position.

The invention is applicable to power switches used in electric power distribution systems such as circuit breakers, transfer switches, network protectors and the like, and will be described as applied in a high current limiting power circuit breaker. FIGS. 1–3 illustrate the pertinent parts of a current limiting power circuit breaker 1 incorporating aspects of the invention. The circuit breaker 1 includes an insulative molded housing 3 that contains and supports a moving contact assembly 5. This moving contact assembly 5 includes a moving contact carrier 7 pivotally supported by legs 9 for rotation about a pivot axis 11. The contact carrier 7 supports a plurality of contact fingers 13 to which are affixed moving contacts 15 adjacent free ends 17.

The moving contact assembly 5 is driven between a closed position shown in FIG. 1 and an open position shown in FIG. 2 by a drive link 19 connected through a crank 21 to a pole shaft 23. The pole shaft is rotated in a well known manner by an operating mechanism (not shown).

Figure 4:
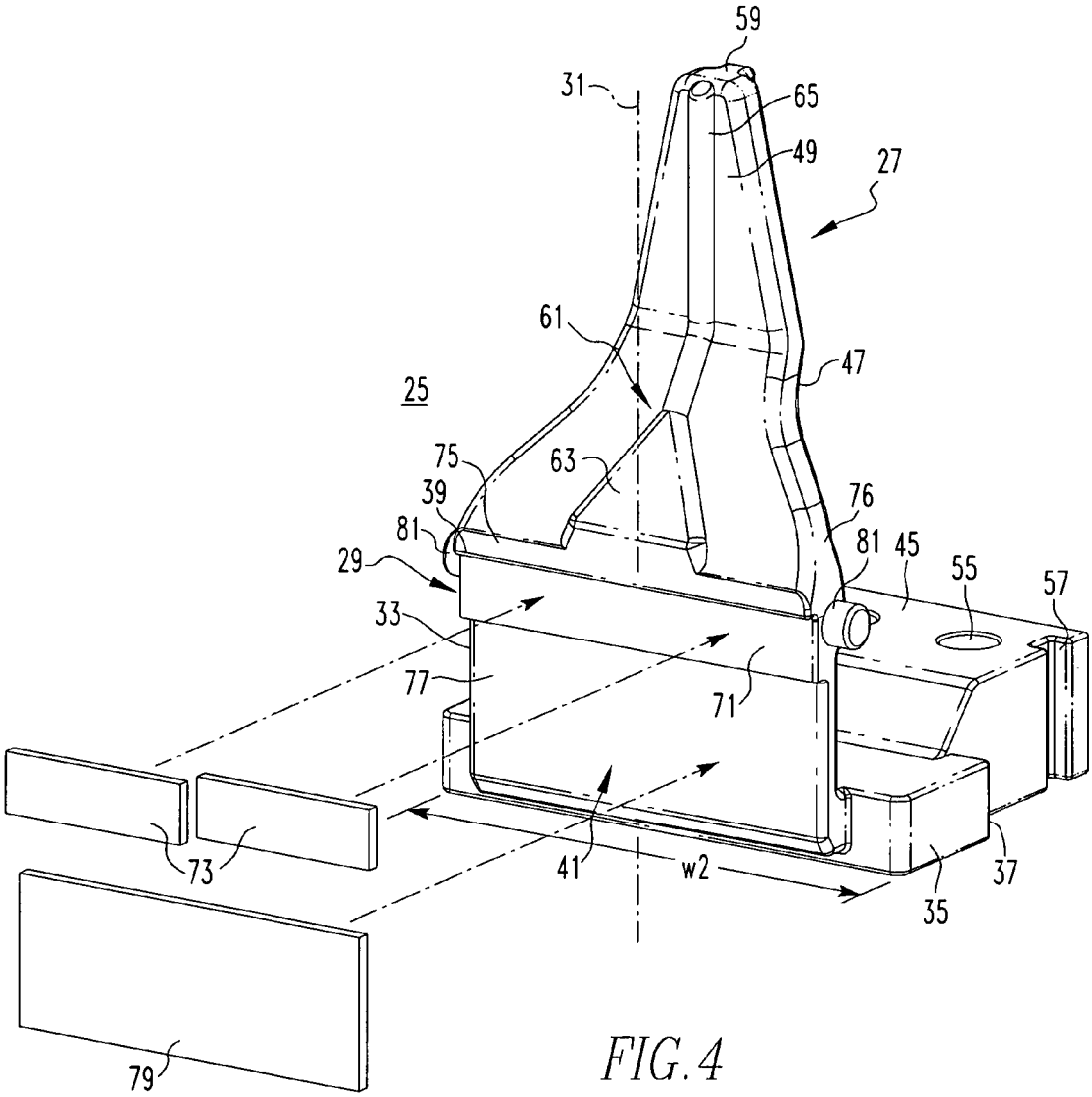
FIG. 4 is an exploded front isometric view of a stationary contact assembly including a monolithic stationary conductor that forms part of the circuit breaker of FIGS. 1–3.
Figure 5:
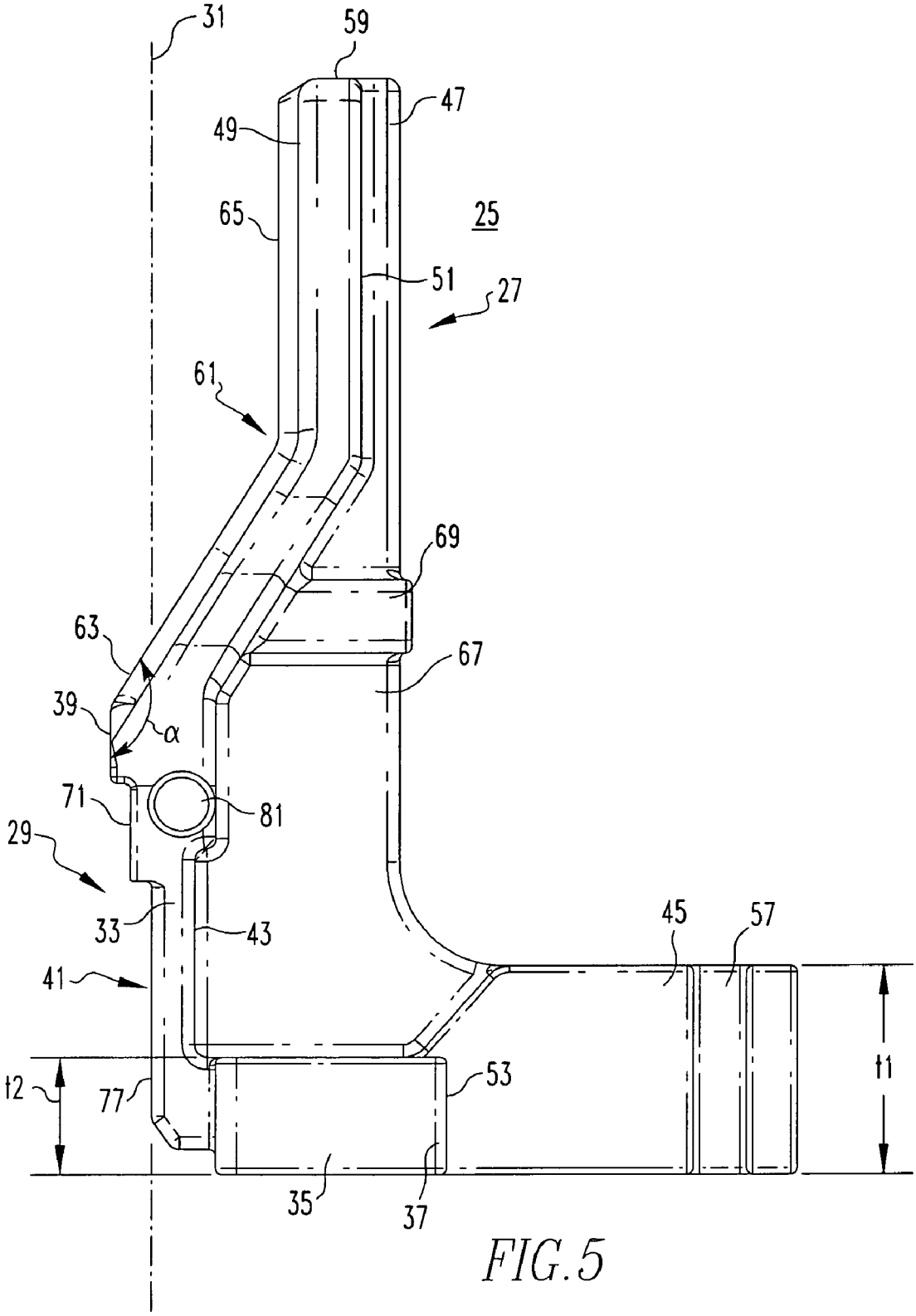
FIG. 5 is a side elevation view of the monolithic stationary conductor shown in FIG. 4.

The power circuit breaker 1 also has a stationary contact assembly 25 that includes a monolithic stationary conductor 27. The stationary contact assembly 25 and the monolithic stationary conductor 27 are illustrated in detail in FIGS. 4–6. As seen there, the monolithic stationary conductor 27 has a medial conductor section 29 with a main axis 31. The conductor section 29 has an in turn an elongated portion 33 extending generally in a direction of the main axis 31 and a transition portion 35 that extends generally transverse to the main axis 31 and forms a first end 37 of the conductor section 29. The elongated portion 33 forms a second, upper end 39 of the conductor section 29. The elongated portion 33 of the conductor section has a front face 41 and a rear face 43.

The monolithic stationary conductor 27 also includes a terminal section 45 extending away from the rear face 43 of the conductor section 29 at the first end 37 formed by the transition section 35. This terminal section 45 extends generally transversely to the main axis 31. In addition, an arc runner section 47 extends from the second end 39 of the conductor section 29 and has a front face 49 and a rear face 51.

The terminal section 45 of the monolithic stationary conductor 27 has a first thickness t1 which is greater than a second thickness t2 of the transition portion 35 for purposes which will be discussed. In addition, the terminal section 45 has a first width w1 which is less than the width w2 of the transition section 35. This forms shoulders 53 on either side of the transition portion 35, again for purposes which will be discussed. The terminal section 45 can have holes 55 and other features such as 57 for attaching various line conductors (not shown) directly or through quick disconnects (not shown).

The arc runner 47 tapers from adjacent the second end 39 of the conductor section 29 toward an arc runner free end 59. On this front face 49 is a generally laterally centered raised area 61 that narrows from adjacent the conductor section 29 toward the free end 59. The central raised area 61 is made up of a tapered raised area 63 tapering from adjacent the conductor section 29 and a longitudinal raised rib 65 extending from this tapered raised area toward the free end 59. In the exemplary monolithic stationary conductor 27, the front face 49 of the arc runner 47, at least adjacent the second end 39 of conductor section 29 forms an obtuse angle □ with the front face 41 of the elongated section 33.

The monolithic stationary conductor 29 also has an integral reinforcing rib 67 projecting from the rear faces 43 of elongated portion 33 and 51 of the arc runner 47 and extending to the terminal section 45. This reinforcing rib 67 resists the high mechanical and electromagnetic forces imposed on the monolithic stationary conductor 27 during closing and current interruption and distortion due to the heat generated by the high current levels. In addition, the reinforcing rib 67 has a thickened medial post 69 extending transversely to the main axis 31, which as will be seen, transfers some of these forces to the housing 3.

The front face 41 of the elongated portion 33 has a recessed seat 71 adjacent the second end 39 of the elongated portion 33 on which are mounted one or more fixed contacts 73. The depth of this recess 71 is sized so that the stationary contacts 73 are flush with the front face 41 at the second end 39 of the elongated portion 33. These even surfaces with little or no gap between the faces of the stationary contacts 73 and the end 39 of the elongated portion 33 ease the movement of the arc formed during interruption of the contact. Rapid movement of the arc improves interruption performance and reduces contact wear. The flush transition, combined with generously rounded front edge corner 75 and side edges 76 on the arc runner, eliminate sharp corners that can attract the arc, stall its movement, and prevent it from centering in the arc chamber. The tapered raised portion 63 on the front face 49 of the arc runner 47 gathers arcs, which may form anywhere across the contacts 73, toward the center as the arc travels up the arc runner 47. In addition to the front edge corner 75 on the arc runner 47, all edges and corners of the monolithic stationary conductor 27 are rounded. A one piece contact, of appropriate length, can also be used.

A second recessed area 77 on the front face 41 of the elongated portion 33 below the recessed contact seat 71 receives an electrically insulative member 79 that can also contain gas evolving material. The monolithic stationary conductor 27 can have other performance improving features, such as the posts 81 on either side of the elongated portion 33 which can serve as mounts for additional gas producing resin material (not shown).

Figure 6:
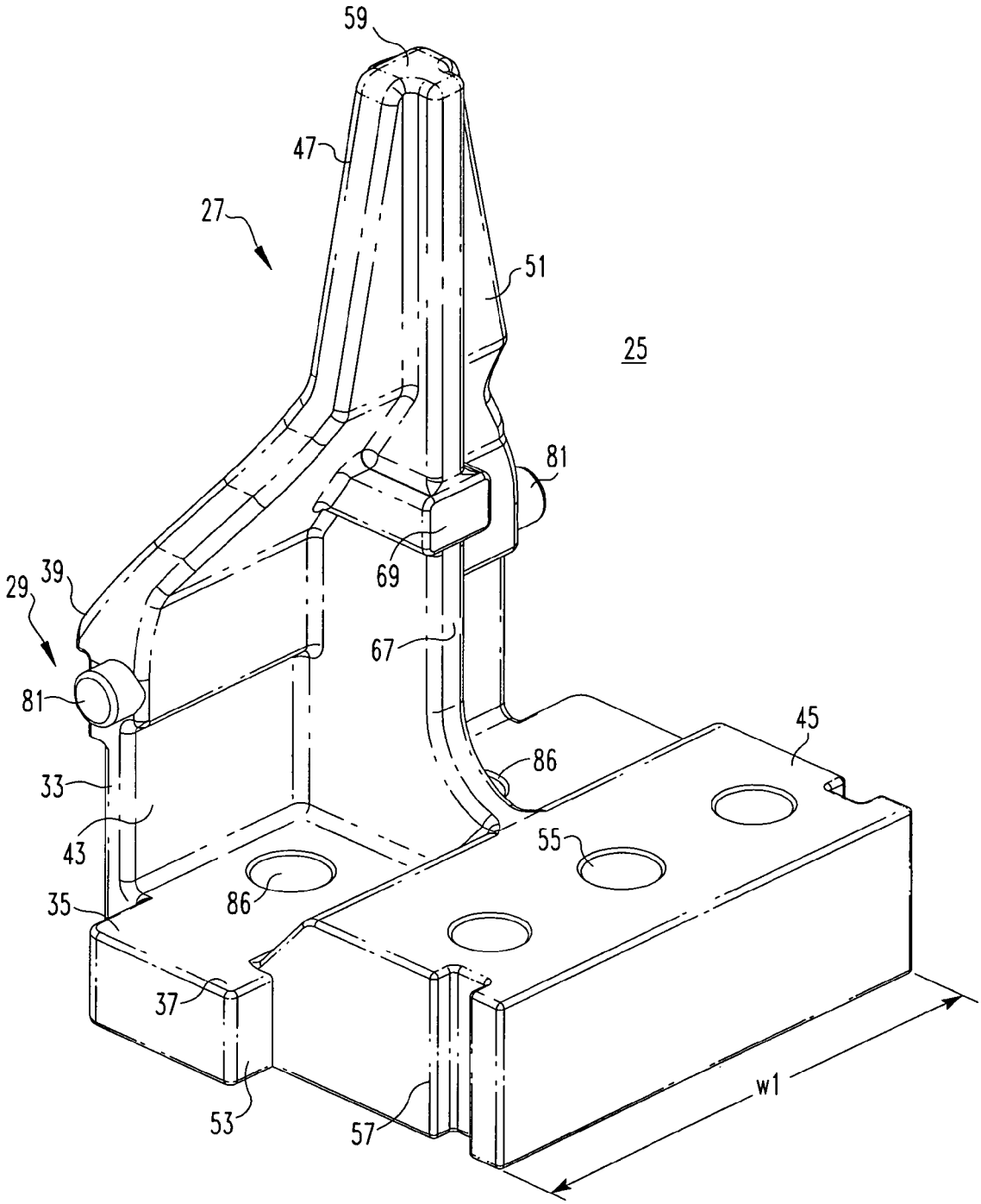
FIG. 6 is a rear isometric view of the monolithic stationary conductor.

Returning to FIGS. 1–3, the stationary contact assembly 25 is mounted in the housing 3 on a ledge 83 with the terminal section 45 projecting through a rear opening 85 and is secured in place by bolts (not shown) projecting through holes 86 in the transition portion 35 (see FIG. 6). In this position, the elongated portion 33 is in spaced parallel relation to the contact fingers 13 when the moving contact assembly 5 is in the closed position as shown in FIG. 1. This establishes a reverse current loop shown by arrow 87. The current path through the breaker is completed by flexible shunts connecting the contact fingers 13 to a load terminal, neither of which are shown for clarity. When the circuit breaker is opened or trips on lesser faults, the pole shaft 23 rotates to pivot the moving contact assembly 5 to the open position shown in FIG. 2. As the moving contacts 15 separate from the fixed contacts 73 an arc is struck, which due to the electromagnetic forces created in the reverse current loop 87 is driven upward along the arc runner section 47 into an arc chute 89 where it is broken into smaller arcs across the arcs plates 91. As the arc is so expanded it cools and is eventually extinguished. Arc gasses generated during interruption and enhanced such as by the gas evolving materials in the insulative member 79 expand upward and out through a vent 92. In so doing they help to move the arc into the arc chute 89 and to further cool it, both of which improve interruption performance.

The moving contact fingers 13 are mounted on an inner carrier 93 which is pivotable with respect to the contact carrier 7 about a pin 95. Springs 97 bias a cam pin 99 against the cam surface 101 on the ends of the inner carrier 93. This spring force is sufficient to maintain the contact fingers 13 in the closed position shown in FIG. 1 up to the withstand current. When this withstand current is exceeded the electromagnetic forces generated by the current in the reverse current loop 87 substantially exceed the bias force and the inner carrier 93 pivots with respect to the contact carrier 7 so that the contact fingers 13 are rotated counterclockwise to the blow open position shown in FIG. 3. It should be noticed that at this point the trip mechanism has not yet had time to respond so that the contact carrier 7 remains in the closed position. As the trip mechanism catches up, the pole shaft 23 will rotate and move the contact carrier 7 to the open position shown in FIG. 1.

The electromagnetic forces generated during such a fault are extremely high. The monolithic stationary conductor 27, due to its unique design is able to withstand these forces and transmit them to the housing 3. The shoulders 53 on the transition section 35 of the monolithic stationary conductor 27 not only accurately position the stationary conductor in the housing in the critical direction of contact closure, but also serve to transmit these forces to the housing. In addition the medial post 69 serves a similar purpose. The reinforcing rib 67 running down the back of monolithic stationary conductor 27 resists distortion of the stationary conductor under these forces. These features of the monolithic stationary conductor 27 similarly resist the high forces encountered during contact closure. It can be appreciated from FIGS. 1–3 that the reduced thickness t2 of the transition portion 35 lengthens the elongated portion 33, which increases the length of the reverse current loop 87 to enhance performance through more rapid blow open. When the contact fingers 13 are blown open, their counterclockwise rotation is stopped by a stop 103. As the trip mechanism responds and the contact carrier 7 is rotated counterclockwise relative to the stop 103, the moving contact fingers 13 are rotated back until the cam surface 101 is reengaged and the mechanism returns to the open position shown in FIG. 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A monolithic stationary conductor for an electric power switch comprising:

a conductor section having a front face and a rear face and a main axis extending between the front face and rear face;

a terminal section extending away from the rear face at a first end of the conductor section and transversely to the main axis;

an arc runner section extending from a second end of the conductor section and having a front face and a rear face;

an integral reinforcing rib projecting from the rear faces of the conductor section and the arc runner section;

wherein the conductor section has an elongated portion starting at the second end and extending along the main axis, and a transition portion at the first end extending transversely to the main axis and joining the terminal section, the integral reinforcing rib extending to the terminal section;

wherein the terminal section has a first thickness in the direction of the main axis and the transition portion has a second thickness extending in the direction of the main axis which is less than the first thickness; and wherein the terminal section has a first width and the transition portion has a second width, the second width being greater than the first width.

2. An electric power switch comprising:

a housing;

a moving contact assembly comprising:

at least one moving contact finger having a free end; and at least one moving contact affixed adjacent the free end of the at least one moving contact finger, the at least one moving contact finger being movable between a closed position and an open position;

a stationary contact assembly comprising:

a monolithic stationary conductor comprising a conductor section having an elongated portion with a main axis extending between a front face and a rear face of the elongated portion and a transition portion forming a first end of the conductor section and extending transversely to the main axis, a terminal section extending from the transition portion at the first end of the conductor section transversely to the main axis, and an arc runner section extending from a second end of the conductor section formed by the elongated portion and having a front face and a rear face;

at least one fixed contact mounted on the front face of the elongated portion adjacent the second end of the conductor section;

an arc chute towards which the arc runner section of the monolithic stationary conductor extends, the at least one moving contact finger when in the closed position extending in spaced relation along the front face of the elongated portion of the conductor section of the monolithic stationary conductor with the at least one moving contact engaging the at least one fixed contact to form a reverse current loop; and wherein the elongated portion of the monolithic stationary conductor has a recessed seat adjacent the second end of the conductor section on which the at least one stationary contact is seated, the recessed seat being sized so that the at least one stationary contact is flush with the front face of the elongated portion at the second end of the conductor section.

3. The power switch of claim 2 wherein the elongated portion of the conductor section has a recessed area between the recessed seat and the transition portion in which is seated an electrically insulative, gas evolving member.

4. An electric power switch comprising:

a housing;

a moving contact assembly comprising:

at least one moving contact finger having a free end; and at least one moving contact affixed adjacent the free end of the at least one moving contact finger, the at least one moving contact finger being movable between a closed position and an open position;

a stationary contact assembly comprising:

a monolithic stationary conductor comprising a conductor section having an elongated portion with a main axis extending between a front face and a rear face of the elongated portion and a transition portion forming a first end of the conductor section and extending transversely to the main axis, a terminal section extending from the transition portion at the first end of the conductor section transversely to the main axis, and an arc runner section extending from a second end of the conductor section formed by the elongated portion and having a front face and a rear face;

at least one fixed contact mounted on the front face of the elongated portion adjacent the second end of the conductor section;

an arc chute towards which the arc runner section of the monolithic stationary conductor extends, the at least one moving contact finger when in the closed position extending in spaced relation along the front face of the elongated portion of the conductor section of the monolithic stationary conductor with the at least one moving contact engaging the at least one fixed contact to form a reverse current loop; and wherein the terminal section has a first width and the transition portion has a second width that is greater than the first width to form shoulders that seat against the housing.

5. The power switch of claim 4 wherein the terminal section has a first thickness in the direction of the main axis and the transition portion of the conductor section has a second thickness, the second thickness being less than the first thickness to extend the reverse current loop.

* * * * *